US007673395B2

(12) United States Patent
Timm et al.

(10) Patent No.: US 7,673,395 B2
(45) Date of Patent: Mar. 9, 2010

(54) DRYER BAR APPARATUS OF A DRYER

(75) Inventors: Gerald L. Timm, Schoolcraft, MI (US); Gregory L. Wedel, Kalamazoo, MI (US)

(73) Assignee: Kadant Johnson Inc., Three Rivers, MI (US)

( * ) Notice: Subject to any disclaimer, the term of this patent is extended or adjusted under 35 U.S.C. 154(b) by 948 days.

(21) Appl. No.: 10/715,889

(22) Filed: Nov. 17, 2003

(65) Prior Publication Data

US 2006/0179677 A1 Aug. 17, 2006

(51) Int. Cl.
*F26B 11/02* (2006.01)

(52) U.S. Cl. ..... 34/125; 34/119

(58) Field of Classification Search ..... 34/125, 34/119, 124, 110, 454; 492/46; 165/89, 165/90

See application file for complete search history.

(56) References Cited

U.S. PATENT DOCUMENTS 3,217,426 A * 11/1965 Barnscheidt et al. ..... 34/110
3,724,094 A * 4/1973 Appel et al. ..... 34/124
3,808,700 A * 5/1974 Kraus ..... 34/124
4,195,417 A * 4/1980 Mathews ..... 34/110
4,267,644 A * 5/1981 Schiel ..... 34/110
4,282,656 A * 8/1981 Schiel ..... 34/110
4,478,168 A * 10/1984 Wimmer ..... 116/82
4,486,962 A * 12/1984 Wedel ..... 34/110
5,564,494 A * 10/1996 Salminen ..... 165/89
7,028,756 B2 * 4/2006 Ives et al. ..... 165/89

* cited by examiner

*Primary Examiner*—Kenneth B Rinehart
(74) *Attorney, Agent, or Firm*—David J. Archer

(57) ABSTRACT

A dryer bar apparatus of a dryer for drying a web in a papermaking machine includes a number of turbulence bars circumferentially spaced equidistantly around the inner surface of the dryer shell for generating turbulence within a layer of condensate. The arrangement is such that uniformity of the transfer of thermal energy in the cross machine direction is maximized while the transfer of thermal energy through the dryer shell from the inner to the outer surface is minimized. Also, the number of turbulence bars is determined by the equation:

$$N=\text{int}\{2\pi Ri/[4\pi(Ri/d)^{1/2}+W]\}$$

in which:
N=the number of turbulence bars in the dryer shell;
int=an integer number of a value in { } brackets;
$\pi$=3.1415;
Ri=the inside radius of the inner surface of the dryer shell in inches;
d=an average depth of the layer in inches;
W=a width of each of the turbulence bars in inches.

16 Claims, 8 Drawing Sheets

DRYER BAR APPARATUS OF A DRYER

BACKGROUND OF THE INVENTION

1. Field of the Invention

The present invention provides a method and apparatus for improving the drying uniformity of steam-heated cylinders. More particularly, the present invention provides a method and apparatus for improving the drying uniformity of steam-heated cylindrical dryers used in a papermaking machine.

2. Background Information

Paper is normally dried by passing it over a series of steam-heated, cast iron dryer cylinders. These cylinders are typically 4', 5', or 6' in diameter, with some paper dryers being as large as 7' in diameter. The steam inside the dryer cylinders transfers its heat to the paper through the dryer shell. As the heat is transferred from the hot steam to the wet paper, the steam inside the dryer condenses. The condensate thus formed is then removed from the dryer cylinder through a syphon pipe that is connected to an external pipe or tank through a rotating seal known as a "rotary joint".

At low rotational speeds, the residual condensate inside the dryer will tend to accumulate in a puddle in the bottom of the dryer cylinder, in a "ponding" state. At higher dryer speeds, the condensate in this puddle will begin to rotate with the dryer shell, and then fall back into the puddle. This is normally referred to as the "cascading" state. At high dryer speeds, the condensate will follow the dryer cylinder around the entire periphery of the dryer shell, in a state that is called "rimming". Most modern papermaking machines operate at speeds well above the speed at which the condensate goes through a transition from cascading into rimming. The subject invention is directed toward machines that operate above the "rimming speed".

Syphon pipes are used to remove the condensate from the dryer cylinders during normal machine operation. The condensate must be removed at the same rate at which it is formed, to avoid filling up the dryer. There are two basic types of syphons as follows: 1/rotating syphons and 2/stationary syphons.

Rotating syphons are fixed to the inside surface of the dryer shell and rotate with the dryer. The outlet of the syphon pipe is maintained at a pressure that is lower than the steam pressure inside the dryer. This pressure differential helps to force the condensate into the syphon, up the radial syphon pipe, and out of the dryer. The differential pressure must be large enough to overcome the centrifugal force and lift the condensate from the rotating dryer shell and up to the dryer centerline. At high speeds, the centrifugal force can be quite large, requiring large differential pressures and large amounts of blow through steam. "Blow through" is that steam that enters the dryer cylinder and exits without condensing (that is, without contributing to drying the paper).

At high speed, even thin residual layers of condensate can form a significant resistance to the transfer of heat from the steam to the dryer shell. At high speed, the rimming layer of condensate is very stagnant and forms an insulating barrier between the steam inside the rimming condensate layer and the inside surface of the dryer shell. Variations in the thickness of the condensate layer can cause significant differences in heat transfer, resulting in non-uniform heating and drying of the paper. Rotating syphons are generally set with a small clearance between the syphon pick-up and the inside surface of the dryer cylinder. Small syphon clearances help to minimize the amount of residual condensate in the dryers and increase the heat transfer rate, but the resulting temperature profiles are still somewhat non-uniform.

Characteristics of the rotating syphons are as follows: 1/Close syphon clearances, 2/thin condensate layers, 3/high operating differential pressures, and 4/good heat transfer rates and temperature profiles (but not as high as a dryer with dryer bars).

Stationary syphons are the other type of dryer syphon. They are held in a fixed position (generally the 6 o'clock position) inside the dryer cylinder, just above the dryer shell. Such stationary syphons are held by a cantilever support tube that extends from an externally mounted rotary joint, through the hollow dryer journal, to the vertical syphon pipe. A stationary syphon pick-up is mounted at the end of the vertical syphon pipe. This pick-up is held above the rotating dryer shell surface with a small clearance in between the two. The stationary syphon can be equipped with a pick-up fitting that is shaped as a scoop. The scoop-shaped pick-up fitting uses the momentum of the rimming condensate to direct the condensate into the syphon pipe, up the vertical syphon pipe, and out of the dryer cylinder. The differential pressure required to remove condensate with a stationary syphon is much less than that required for a rotating syphon and the amount of blow through required for stable evacuation of the condensate is correspondingly reduced. The pick-up, however, tends to create turbulence in the rimming condensate. The turbulence in the vicinity of the syphon is greater than it is across the rest of the dryer shell. This increased turbulence produces a higher heat transfer rate through the condensate in the syphon area and a corresponding non-uniformity in the dryer surface temperature profile.

Characteristics of the stationary syphons are as follows: 1/Larger syphon clearances, 2/thicker condensate layers, 3/lower heat transfer rates, 4/poor temperature profiles, 5/low operating differential pressures, and 6/reduced blow through flow rates.

Dryer bars were developed to generate turbulence in the rimming layer, in order to increase the rate of convective heat transfer through the condensate layer. Dryer bars consist of a series of metal bars that are located inside the dryer cylinder. The bars are held by various means against the inside surface of the dryer cylinder. The bars tend to generate turbulence in the rimming layer of condensate that forms between the individual bars. This increase in condensate turbulence increases the rate of heat transfer and also tends to improve the uniformity of heat transfer from the dryer cylinder.

Barnscheidt and Staud first disclosed the concept of dryer bars in U.S. Pat. No. 3,217,426. Specific formulae for predicting the optimum spacing between bars was later added by Appel and Hong in U.S. Pat. No. 3,724,094. When the bars are positioned at or near the optimum spacing, the dryer bars will enhance the natural tendency for the condensate to slosh circumferentially. Near the optimum spacing, the condensate depth will be "in tune" with the bar spacing and a resonant sloshing motion will occur between the bars.

There are a number of prior art configurations of dryer bars. Most of the variations in these configurations are in the details of holding the bars to the inside surface of the dryer shell. One method, for example, uses a series of magnets to hold the bars to the dryer shell surface as taught by Mathews in U.S. Pat. No. 4,195,417. Another method uses a series of bars that are magnetic as disclosed by Wedel in U.S. Pat. No. 4,486,962. Other methods have been disclosed by Kraus in U.S. Pat. No. 3,808,700, by Schiel in U.S. Pat. No. 4,267,644, and by Schiel in U.S. Pat. No. 4,282,656, using various types of springs and pins.

In each of these prior art arrangements, the bars have consisted of solid metal bars. The number of rows of bars in each dryer cylinder is in the range of 18 to 36 for 5' and 6' diameter dryers. Bars used in commercial embodiments have square or rectangular cross-sections, ranging from 0.25"×0.25" to as large as 0.5"×1". The cross-section of the bars is selected based on such factors as the number of rows of bars in the dryer, the amount of condensate that is expected to be rimming inside the dryer, the cost of the bars, the rigidity of the bars, the specific system for holding the bars in place, and the ability to handle the bars during installation.

Most prior art bars are held against the dryer shell using a series of hoop segments. Various loading systems are installed between flanges at the end of the hoop segments, to force the segments apart and press the bars against the inside surface of the dryer shell. One of these systems is a simple threaded turnbuckle with locking nuts. Other, more sophisticated, designs use various coil, barrel, or Bellville washer springs between the hoop segments. A more recent development uses a unique compression bolt disclosed in co-pending application U.S. Ser. No. 10/151,407 filed May 17, 2002, now U.S. Pat. No. 7,028,756 issued on Apr. 18th 2006.

Dryer bars not only increase the rate of heat transfer through the condensate layer, but they also increase the uniformity of heat transfer. They can be used with either rotating or stationary syphons. The syphon clearance is selected to produce a residual condensate depth that will produce high heat transfer with the selected dryer bar configuration. By proper selection of the syphon clearance, the heat transfer rate under the stationary syphon pick-up can be matched to that of the dryer bars, producing a high dryer surface temperature and a uniform surface temperature profile.

More specifically, papermaking machines require a uniform dryer surface temperature profile in order to achieve a uniform cross-machine moisture profile in the paper that is produced. Dryer bars can be used to achieve this. Some papermaking machines, however, cannot operate with the correspondingly high dryer surface temperatures that are produced by the dryer bars.

The fibers in the wet paper of a fine paper machine, for example, will tend to stick to dryer surfaces that are too hot. This causes a "picking" phenomenon in which wet fibers are pulled off the sheet surface. This picking causes a loss in sheet quality, linting of the finished sheet, defects in the sheet surface, and poor machine runnability. The first few dryers following a size press or coater can have similar problems when the dryer surface temperatures are too high.

The conventional approach for these dryer cylinders is to reduce the steam pressure inside the dryers. This produces a corresponding reduction in steam temperature. The required steam pressures, however, may be lower than the dryer steam and condensate control system can achieve. Wet end dryers of newsprint and fine paper machines, for example, must often operate in a vacuum condition in order to achieve low enough steam temperatures. The vacuum condition is achieved using large heat exchangers that require large flow rates of cooling water to condense the blow through steam from the dryers and generate the vacuum inside the dryer.

At high dryer speeds, the vacuum condenser has to produce the required vacuum level in the dryers and also produce sufficient differential pressure to evacuate the condensate from the dryer.

This differential pressure required to evacuate the dryers and the resulting blow through flow rates can be quite large when using rotating syphons. The vacuum condenser often has inadequate capacity to generate the required differential pressure and handle the resulting blow through.

With stationary syphons, the differential pressure required to evacuate dryers and the resulting blow through is much less, so stationary syphons are often used in the wet end dryers of high-speed machines. However, with stationary syphons, the cross-machine dryer surface temperature profiles are quite non-uniform.

In order to achieve a uniform dryer surface temperature profile, dryer bars are generally used with stationary syphons. Conventional dryer bars, however, increase the rate of heat transfer and require a further reduction in operating steam pressure to achieve the same low dryer surface temperature.

What is required is a dryer bar configuration that can produce a uniform dryer surface temperature profile, but at the same time produce low dryer surface temperatures. This configuration is the subject of this invention. It can be used with rotating or with stationary syphons, but it has its best application to wet end dryers that have stationary syphons.

In order to achieve a uniform dryer surface temperature profile and a low heat transfer rate at the same time, in dryers with stationary syphons, the dryer bars of the subject invention are selected to operate at the quarter-resonance spacing.

The resonant spacing, as outlined in the prior art patent of Appel and Hong is given by the following equation:

$$S=\pi(R_i\delta)^{1/2}$$

where:

S=Spacing between bars, inches $\pi$=3.1415

$R_i$=Inside radius of the dryer shell, inches $\delta$=Average condensate depth in the dryer, inches At the quarter-resonant condition, the spacing between bars would be four times larger than that given by the above equation. The corresponding condensate depth would be less than 10% of the value indicated by the above equation. The quarter-resonant spacing is given by:

$$S=4\pi(R_i\delta)^{1/2}$$

The corresponding number of bars in the dryer cylinder according to this invention would be given by the following equation:

$$N=\text{int}\{2\pi R_i/(S+W)\}$$

$$N=\text{int}\{[2\pi R_i/[4\pi(R_i\delta)^{1/2}+W]\}$$

Where:

int=Integer number of value in {brackets}

N=Number of bars in the dryer

W=Width of the dryer bars in inches.

The number of dryer bars must be an integer number. That is, the value in brackets in the above equations must be rounded either up or down to a whole number N. The number of bars that is used should be within 2 of the exact number calculated by the above equation.

The precise integer number can be selected based on practical considerations, as outlined later.

The rate of heat transfer will remain quite low if the number of bars in the dryer cylinder is significantly lower than that found in the prior art, and the condensate depth is not correspondingly increased. This is expected, based on prior art teaching. We have discovered, however, that the cross-machine heat transfer profile remains quite uniform when the dryer bars are operating at the quarter-resonant spacing, even though this is far from the spacing at which the dryer bars produce a resonant oscillation. This is a significant feature for those papermaking machines that require a low dryer surface temperature and the temperature uniformity of dryer bars.

The bars of the subject invention are held against the dryer shell using a series of hoop segments, as is done in most prior art configurations. In order to hold the bars tightly against the dryer shell, these hoop segments are pressed toward the shell surface using any one of a number of the prior art loading configurations.

The bars of the subject invention can alternately be solid bars or hollow tube bars. They may be mild steel or stainless steel. Stainless steel hollow tube bars are the preferred embodiment, as they are lighter in weight, they can be manufactured economically in stainless steel, and are stiffer than solid bars even when they are lighter in weight.

This invention was tested in a dryer cylinder that was 5' in diameter and 246" in width. As a benchmark, a commercial stationary syphon was installed in its normal location near the end of the dryer. The dryer was heated with steam and its surface subjected to a cooling load (simulating the drying of paper). The resulting dryer surface temperature profile was measured and recorded. The temperature profile is highly non-uniform in the cross-machine position, due to the high turbulence in the area of the stationary syphon and the thick condensate layer in the area away from the stationary syphon.

Commercial dryer bars were then installed in the same dryer, with the same stationary syphon, operating at the same dryer speed, steam condensing rate, and steam pressure. The resulting dryer surface temperature profile was measured and recorded. The dryer bars produced a significant improvement in the dryer surface temperature profile, as well as an increase in the temperature level. This demonstrates the effectiveness of dryer bars in correcting the non-uniformity in the dryer surface temperature profile, but also highlights the fact that the dryer surface temperatures increase significantly with dryer bars.

A second test was then conducted, again with a set of commercial dryer bars, again with a cantilever stationary syphon. The syphon clearance was set to achieve a condensate film thickness of approximately 0.25 inch, which was the optimum for the bar configuration, according to the prior art invention of Appel and Hong. The dryer steam pressure for these tests was set at 14.5 psig. The saturated steam temperature at this pressure is 248.8 degrees F.

The resulting temperature profile for this configuration indicated that the average dryer surface temperature profile was 225.4 degrees F. This value is quite high, as expected for a paper dryer with conventional dryer bars installed. The dryer surface temperature was only 23.4 degrees F below the steam temperature. The cross-machine heat transfer profile was again very uniform, as expected for a commercial dryer bar configuration.

Dryer bars with the configuration of the subject invention were then installed in the same dryer cylinder along with the same cantilever stationary syphon. The syphon clearance was set to achieve a condensate film thickness of approximately 0.25 inch. The optimum condensate depth, as prescribed by the prior art invention of Appel and Hong, would be approximately 3 inches.

The resulting temperature profile for this configuration indicated that the average dryer surface temperature profile was only 219 degrees F. This value is quite low, particularly considering that dryer bars were installed in the dryer. Specifically, the dryer surface temperature was 29.8 degrees F below the steam temperature. With conventional dryer bars, the average dryer surface temperature was 23.4 degrees F below the steam temperature. That is, the temperature drop for the dryer with dryer bars according to this invention was 26% higher than for the dryer with conventional dryer bars. This allows the dryer to operate with the same steam pressure, yet achieve a lower dryer surface temperature and fewer tendencies for picking, linting, and problems with runnability.

Not only was the dryer surface temperature lower than with conventional dryer bars, the cross-machine temperature profile remained flat. The standard deviation of the temperature profile was only 0.7 degrees F.

In the preferred embodiment of the subject invention, a 5' diameter dryer is equipped with 6 hollow rectangular stainless steel bars, each disposed in an axial direction and each positioned and equally spaced adjacent to the inside surface of the paper drying cylinder.

The number of bars is significantly less than that taught by the prior art. Additionally, the condensate depth is significantly less than that taught by the prior art for this number of dryer bars. For example, in a 5' diameter dryer cylinder, the typical prior art dryer bar configuration would have 18-32 rows of bars. The corresponding centerline spacing of the bars would range from 10" down to 5.7". The optimum condensate depths would range from 0.29" to 0.08".

In the preferred embodiment, the condensate depth would remain in the above range, but the bar spacing would be increased by a factor of 4. For example, a prior art dryer with a 57.75" inside diameter and 18 rows of 1" wide bars would have a spacing between bars of 9.08". The optimum condensate depth according to the prior art would be 0.29". In the preferred embodiment of this invention, the spacing between bars would be increased to 36.32". This would require 4.9 bars in the dryer [3.1415×57.75"/(36.32+1)]. This value would be rounded to a close integer number (for example, to 3, 4, 5, 6, or 7).

In the preferred embodiment, each axial segment of bars is held against the dryer surface with hoop assemblies and each hoop assembly consists of 3 segments. In the preferred embodiment, there is one threaded fastener between each of the hoop segments. Each fastener has one threaded nut, for tightening the hoops, and one back-up jam nut. The hoop segments are attached to the rectangular dryer bars with pins. This configuration is disclosed in the aforementioned co-pending application.

With the preferred embodiment, each of the hoop segments would be identical if the number of bars selected according to the present invention is 6. This is the closest integer number of bars that is directly divisible by the number of hoop segments (6/3=2 bars per hoop segment).

Because of the number of bars in the present invention is significantly less than those used in the prior art, the span between bars is correspondingly much longer. In order to prevent the hoop segments from bowing between the bars, short spacers are placed under the hoops between bars. These spacers support the hoop segments between the bars and prevent the hoops from bowing.

In the method according to this invention, the dryer surface temperature profile is improved while the dryer surface temperature level is kept low, by installing a small number of bars in the dryer cylinder and maintaining a low level of condensate in the dryer.

Therefore, it is a primary feature of the present invention to provide a dryer bar apparatus for a dryer that overcomes the problems associated with the prior art arrangements.

Another feature of the present invention is the provision of a dryer bar apparatus that reduces the number of dryer bars.

A further feature of the present invention is the provision of a dryer bar apparatus that maintains cross-machine direction temperature uniformity while decreasing the transfer of thermal energy.

Other features and advantages of the present invention will be readily apparent to those skilled in the art by a consideration of the detailed description of a preferred embodiment of the present invention contained herein.

SUMMARY OF THE INVENTION

The present invention relates to a dryer bar apparatus of a dryer for drying a web in a papermaking machine. The apparatus includes a rotatable dryer shell of cylindrical configuration, the dryer shell having an outer surface for drying the web. The dryer shell has an inner surface which defines an enclosure, the inner surface having a radius $R_i$. The enclosure is connected to a source of pressurized steam such that in operation of the dryer, a transfer of thermal energy from the steam within the enclosure through the inner surface of the dryer shell to the outer surface of the dryer shell is achieved so that the web is dried. A syphon is disposed within the enclosure for controlling a layer of condensed steam accumulating adjacent to the inner surface of the dryer shell during operation of the apparatus. A number of turbulance bars are disposed within the enclosure, each of the turbulance bars extending in a cross machine direction in contact with the inner surface. The bars are circumferentially spaced equidistantly around the inner surface of the dryer shell for generating turbulance within the layer. The arrangement is such that uniformity of the transfer of thermal energy in the cross machine direction is maximized while the transfer of thermal energy through the dryer shell from the inner to the outer surface is minimized. Also, the number of turbulance bars is determined by the equation:

$$N=\text{int}\{2\pi R_i/[4\pi(R_i/\delta)^{1/2}+WJ\}$$

in which:

N=the number of turbulance bars in the dryer shell;

int=an integer number of a value in { } brackets;

$\pi$=3.1415;

$R_i$=the inside radius of the inner surface of the dryer shell in inches;

$\delta$=an average depth of the layer in inches;

W=a width of each of the turbulance bars in inches.

In another aspect of the present invention a dryer bar apparatus of a dryer for drying a web in a papermaking machine, includes a rotatable dryer shell of cylindrical configuration, the shell defining an outer and an inner surface. A number of dryer bars are pressed outwardly against the inner surface, each of the bars extending in a cross-machine direction along the inner surface. Each bar is spaced from an adjacent bar by a quarter-resonant spacing such that a rate of heat transfer through the dryer shell from the inner to the outer surface is minimized while optimizing a temperature uniformity in the cross machine direction. The quarter-resonant spacing is determined by an equation:

$$S=4\pi(R_i\delta)^{1/2} \text{ in which;}$$

S=the quarter-resonant spacing;

$\pi$=3.1415;

$R_i$=the inside radius of the inner surface of the dryer shell in inches;

$\delta$=an average depth of a layer of condensed steam disposed adjacent to the inner surface in inches.

In a more specific embodiment of the present invention, the apparatus includes dryer bars. A cross-section of each of the bars is within a range from 0.25 inches×0.25 inches to 1.0 inches×1.50 inches. Each of the bars is metallic and of hollow tubular configuration. The apparatus includes at least one hoop for pressing each of the bars against the inner surface of the dryer shell. The at least one hoop includes at least one segment.

Also, the at least one hoop includes a number of segments within a range 2 to 4, each segment having a first and a second end. A segment fastener is disposed between the first and second end of the segment for forcing adjacent segments apart. Each fastener is threaded on one of the ends thereof. Each of the hoop segments defines a hole in each end thereof, for engagement with a segment fasteners. Each of the segment fasteners has a head that passes through the hole in the end of the segment. A hexagonal socket head is defined by the fastener for permitting tightening of the fastener by a power tool. A cylindrical pin is provided for connecting each of the bars to an adjacent segment.

More specifically, the pin has an interference boss to hold the pin in the segment. The pin extends far enough out of the segment and into the bar so that disengagement of the pin from the segment is prevented.

The present invention also provides a method of improving a cross-machine directional heat transfer profile of a papermaking dryer cylinder. The method includes the steps of holding a number of bars axially against an inside surface of the dryer cylinder, the number being within a range 3 to 9. Hoop segments are then located within the dryer cylinder such that each segment is disposed in a generally circumferential position.

The dryer bars according to the present invention are also applicable to other dryer diameters, including small paper dryers and large (Yankee) tissue dryers.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
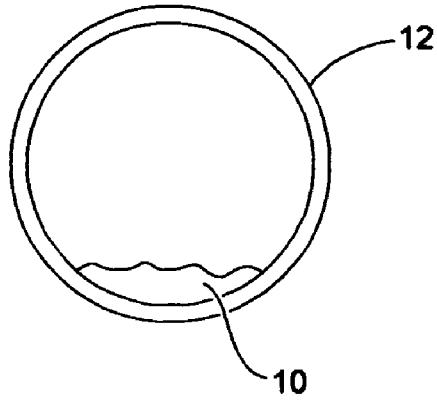
FIG. 1 is a side elevational view partly in section of a typical dryer showing ponding.

FIG. 1 is a side elevational view partly in section of a typical dryer showing ponding of the steam condensate 10 at the bottom of a dryer cylinder 12.

Figure 2:
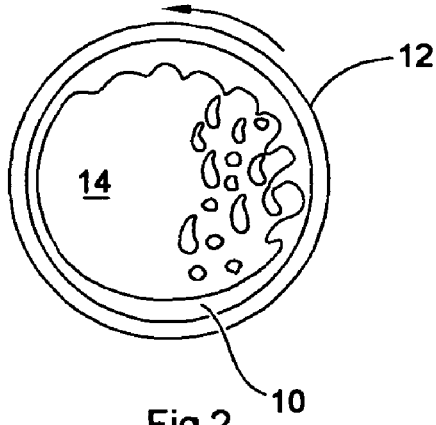
FIG. 2 is a side elevational view partly in section of a typical dryer showing cascading.

FIG. 2 is a side elevational view partly in section of a typical dryer showing cascading of the steam condensate 10 within an enclosure 14 of the dryer cylinder 12.

Figure 3:
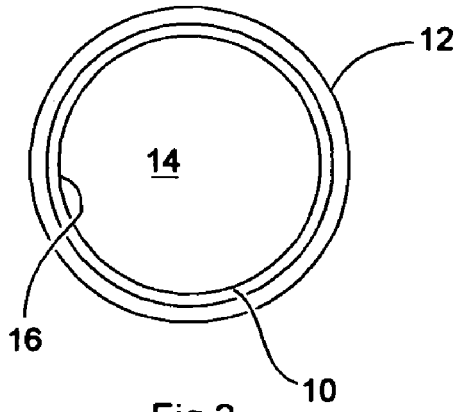
FIG. 3 is a side elevational view partly in section of a typical dryer showing rimming.

FIG. 3 is a side elevational view partly in section of a typical dryer showing rimming of the steam condensate 10 within the enclosure 14 of the dryer cylinder 12, the rimming being disposed adjacent to the inner surface 16 of the dryer cylinder or dryer shell 12.

Figure 4:
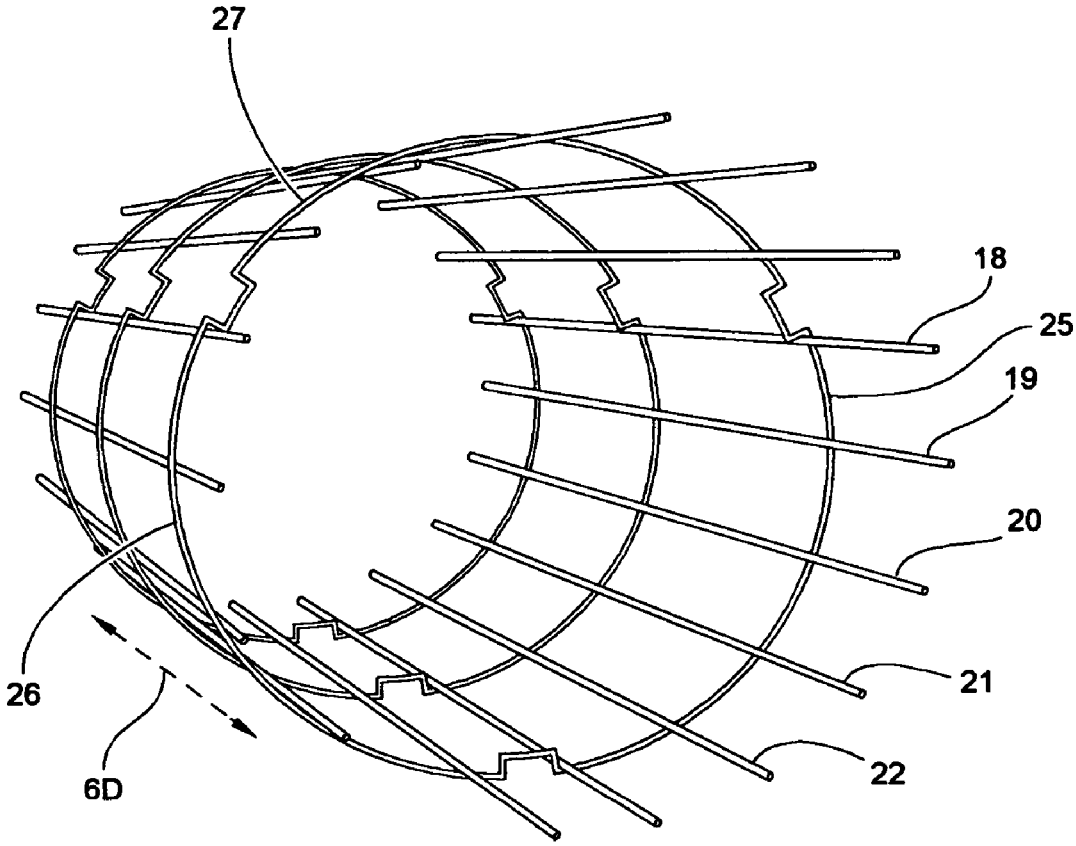
FIG. 4 is a perspective view of a number of dryer bars and hoop segments according to a prior art arrangement.

FIG. 4 is a perspective view of a number of dryer bars 18, 19, 20, 21 and 22 and hoop segments 24, 25 and 26 according to a prior art arrangement.

Figure 5:
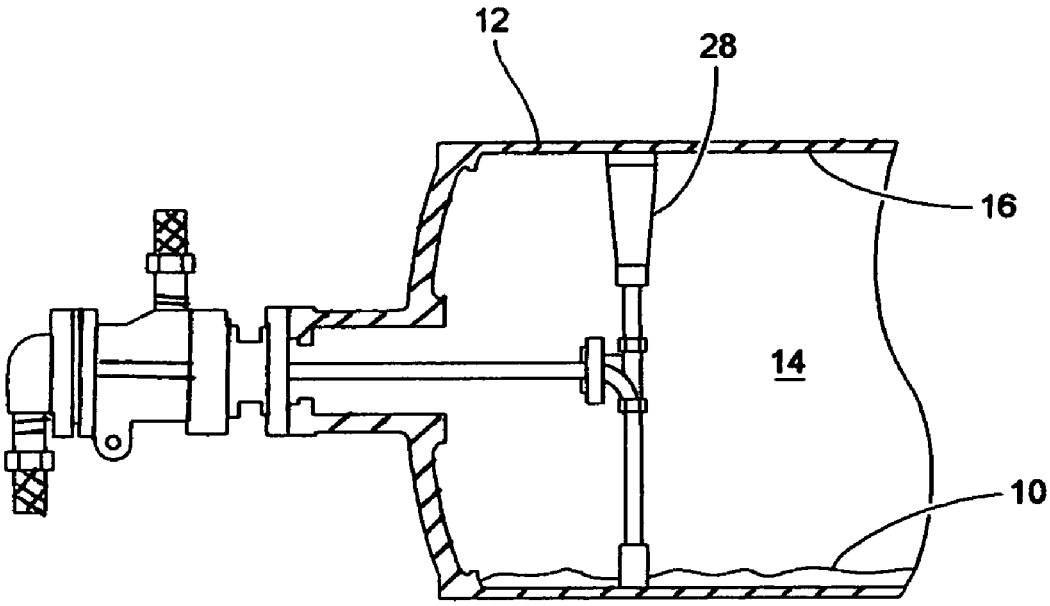
FIG. 5 is a side elevational view partly in section of a rotating syphon.

FIG. 5 is a side elevational view, partly in section, of a rotating syphon 28 which rotates within the enclosure 14 of the dryer shell 12 for removing a layer of condensate 10 from an inner surface 16 of the dryer shell 12.

Figure 6:
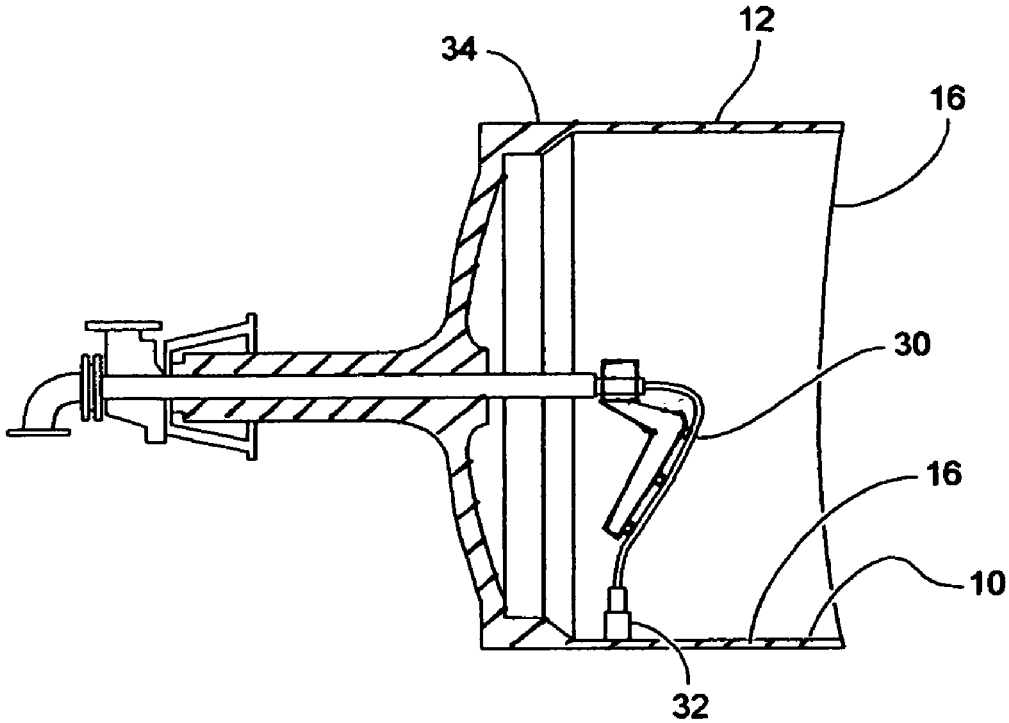
FIG. 6 is a sectional view of a cantilever stationary syphon.

FIG. 6 is a sectional view of a cantilever stationary syphon 30 disposed within a dryer shell 12 for removing a layer of condensate 10 from the inner surface 16 of the shell 12.

Figure 7:
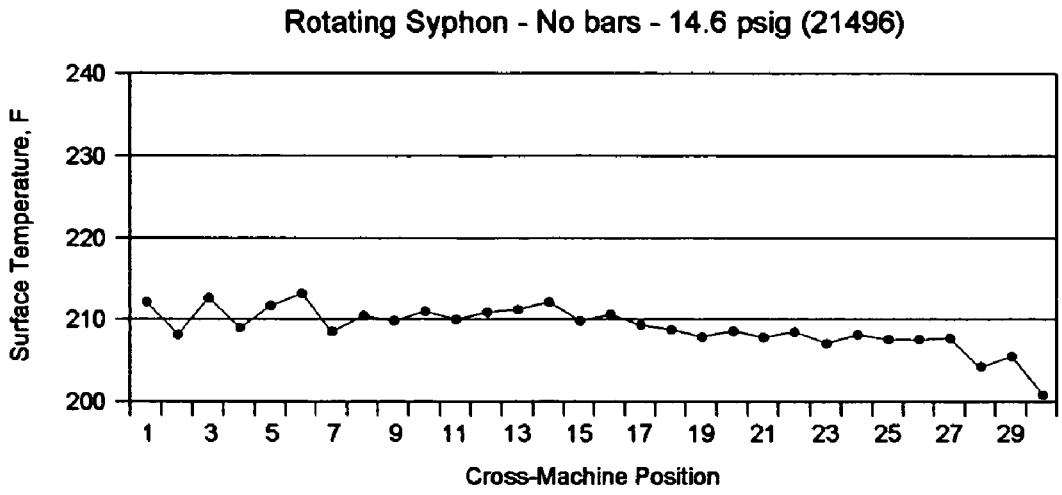
FIG. 7 is a cross-direction surface temperature profile for a rotating syphon with no bars.

FIG. 7 is a cross-machine direction surface temperature profile for a rotating syphon 28 with no bars installed. The apparatus is operating at a steam pressure of 14.5 psig and shows a lack of cross machine direction CD temperature uniformity.

Figure 8:
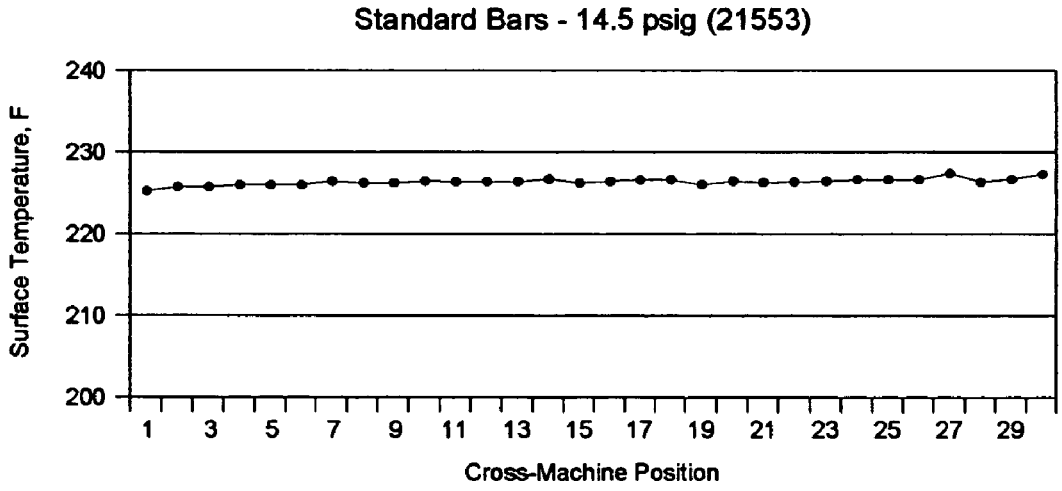
FIG. 8 is a cross-direction surface temperature profile for a stationary syphon with bars.

FIG. 8 is a cross-machine direction CD surface temperature profile for a stationary syphon 30 with bars 18-22 showing a relatively uniform cross-machine direction CD temperature uniformity at the outer surface 34 of the shell 12 as shown in FIG. 6.

Figure 9:
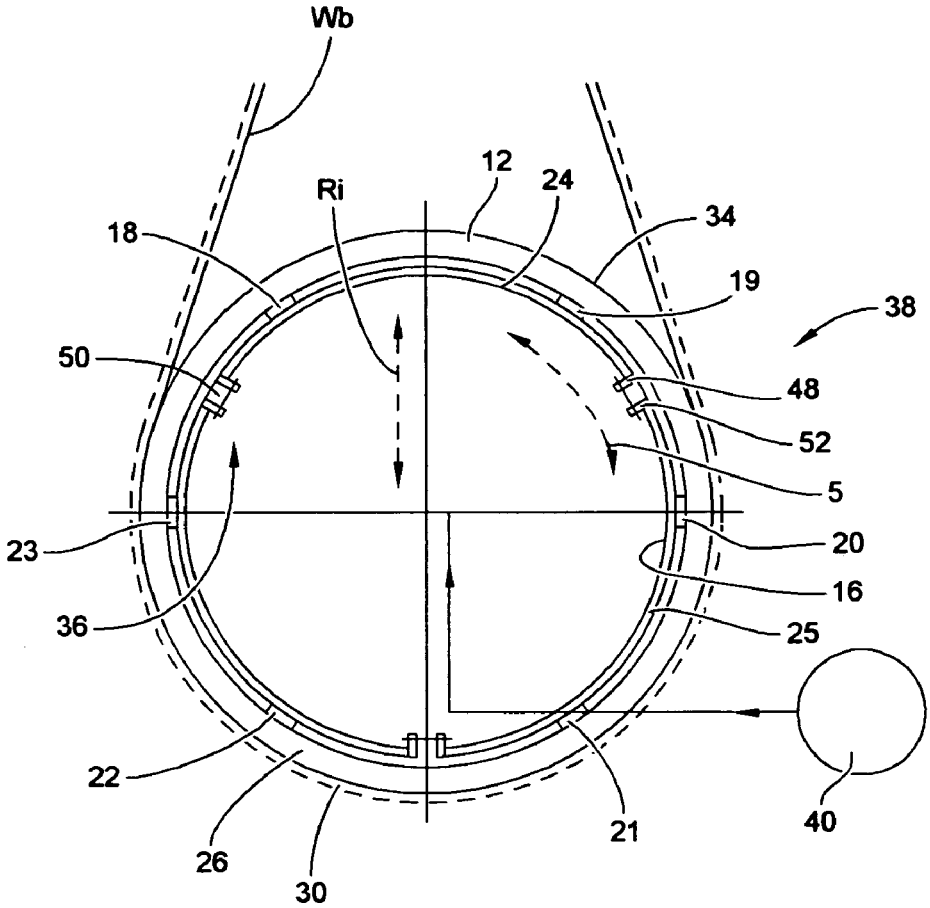
FIG. 9 is a side sectional view of a dryer bar configuration according to the present invention.

FIG. 9 is a side sectional view of a dryer bar configuration according to the present invention. As shown in FIG. 9, a dryer bar apparatus generally designated 36 of a dryer 38 is disclosed for drying a web $W_b$ in a papermaking machine. The apparatus 36 includes a rotatable dryer shell 12 of cylindrical configuration, the dryer shell 12 having an outer surface 34 for drying the web $W_b$. The dryer shell 12 has an inner surface 16 which defines an enclosure 14, the inner surface 16 having a radius $R_i$. The term "shell" in the present disclosure is that part of the dryer disposed between the front and rear ends or heads of the dryer and is that part of the dryer that is of cylindrical configuration having an inner and an outer surface. The enclosure 14 is connected to a source of pressurized steam 40 such that in operation of the dryer 38, a transfer of thermal energy from the steam within the enclosure 14 through the inner surface 16 of the dryer shell 12 to the outer surface 34 of the dryer shell 12 is achieved so that the web $W_b$ is dried. The dryer 38 according to the present invention as shown in FIG. 9 is provided with a siphon 30 which is a similar syphon to that shown and described with regard to FIG. 6. The siphon 30 which is a stationary syphon is disposed within the enclosure 14 for controlling a layer 32 of condensed steam 10 accumulating adjacent to the inner surface 16 of the dryer shell 12 during operation of the apparatus 36. A number N of turbulance bars 18, 19, 20, 21, 22 and 23 are disposed within the enclosure 14, each of the six turbulance bars 18 to 23 extending in a cross machine direction CD, as shown in FIG. 4, in contact with the inner surface 16. The bars 18 to 23 are circumferentially spaced equidistantly by a space S around the inner surface 16 of the dryer shell 12 for generating turbulance within the layer 32. The arrangement is such that uniformity of the transfer of thermal energy in the cross machine direction CD is maximized while the transfer of thermal energy through the dryer shell 12 from the inner surface 16 to the outer surface 34 is minimized. Also, the number N of turbulance bars is determined by the equation:

$$N=\text{int}\{2\pi R_i/[4\pi(R_i\delta)^{1/2}+W]\}$$

in which:

N=the number of turbulance bars 18 to 23 in the dryer shell 12;

int=an integer number of a value in { } brackets;

$\pi$=3.1415;

$R_i$=the inside radius of the inner surface 16 of the dryer shell 12 in inches;

$\delta$=an average depth of the layer 32 in inches;

W=a width of each of the turbulance bars 18-21 in inches.

Figure 10:
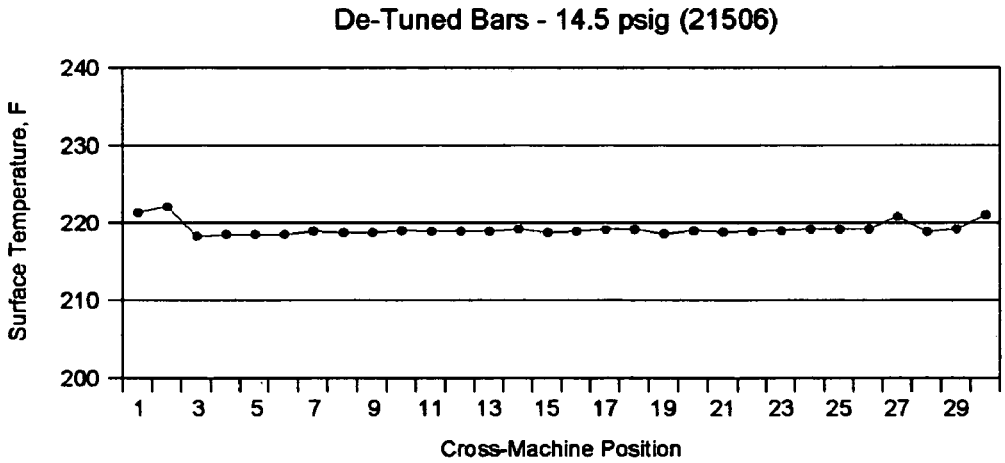
FIG. 10 is a cross-machine direction surface temperature profile for a stationary syphon with dryer bars according to the present invention.

FIG. 10 is a cross-machine direction CD surface temperature profile for a stationary syphon 30 with dryer bars 18 to 23 according to the present invention. As shown in FIG. 10, the steam pressure is 14.5 psig and the outer surface 34 has a temperature which is fairly uniform in a cross-machine direction CD such temperature being approximately 220 degrees F.

Figure 11:
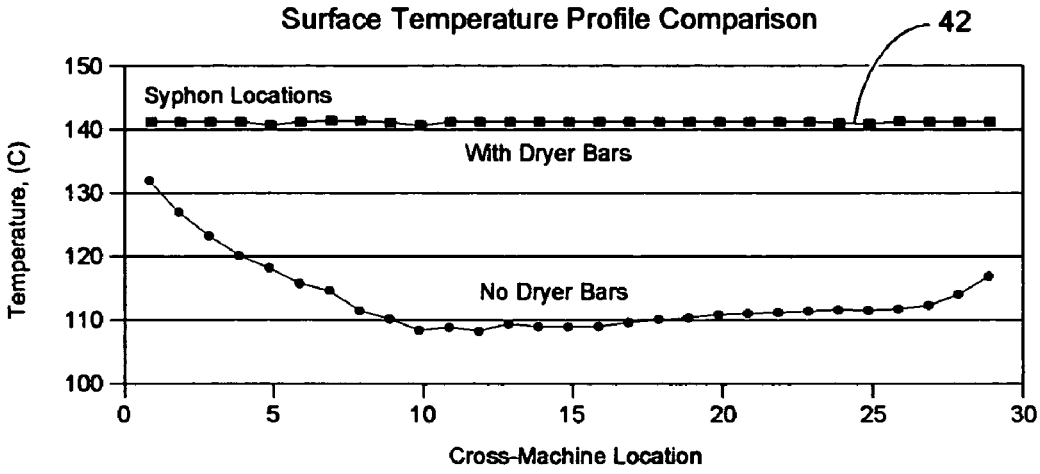
FIG. 11 is a surface temperature profile comparison showing a dryer with a stationary syphon with and without dryer bars.

FIG. 11 is a surface temperature profile comparison showing a dryer with a stationary syphon 30. The top graph 42 shows the relatively uniform CD temperature profile when dryer bars 18 to 23 are used. The bottom graph 44 shows the extremely non uniform temperature profile in a CD when no dryer bars are used.

Figure 12:
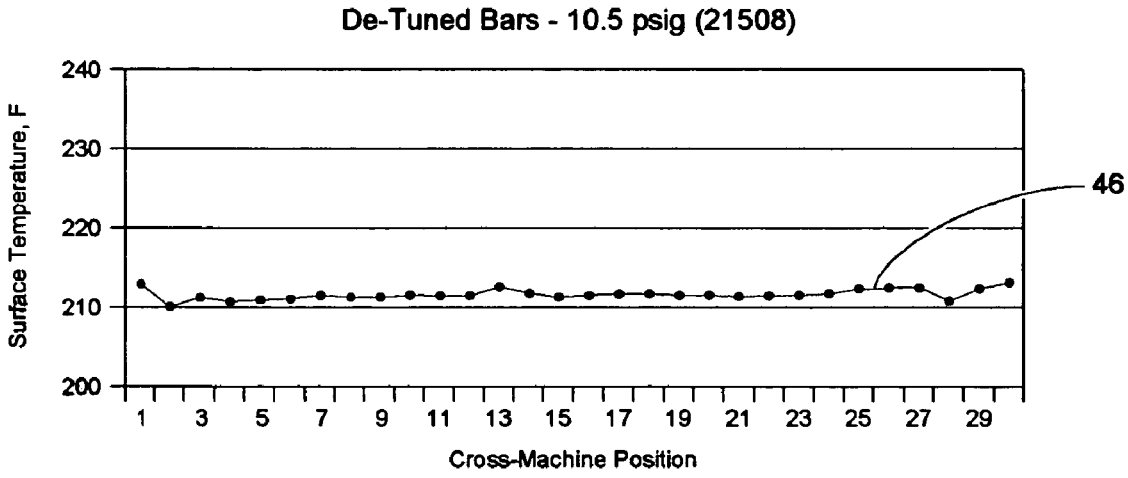
FIG. 12 is a graph showing the amount of steam pressure reduction required according to the present invention.

FIG. 12 is a graph 46 showing the amount of steam pressure reduction to 10.5 psig required according to the present invention using the six dryer bars 18 to 23 as shown in FIG. 9. As shown in FIG. 12, the temperature is reduced to a uniform 210 degrees F along a CD which is particularly advantageous at the wet end of the dryer section so that picking of the fibres from the web is inhibited while maintaining the uniformity in application of heat in a cross machine direction.

In a more specific embodiment of the present invention, the number N of turbulance bars is equal to N±1. However, in another embodiment, the number N of turbulance bars is equal to N±2.

As shown in FIG. 9, the apparatus 36 includes a further number FN of hoop segments 24, 25 and 26 respectively that are spaced circumferentially along the inner surface 16 of the dryer shell 12 for holding the turbulance bars 18 to 23 in contact with the inner surface 16. The number of turbulance bars 18 to 23, that is six bars, is a multiple of the further number FN of hoop segments 24 to 26 which amounts to three segments.

In another aspect of the present invention as shown in FIG. 9, a dryer bar apparatus 36 of a dryer 38 for drying a web $W_b$ in a papermaking machine includes a rotatable dryer shell 12 of cylindrical configuration, the shell 12 defining an outer surface 34 and an inner surface 16. A number N of dryer bars 18 to 23 are pressed outwardly against the inner surface 16 with each of the bars 18 to 23 extending in a cross machine direction CD along the inner surface 16. Each bar such as bar 19 is spaced from an adjacent bar such as bar 20 by a quarter-resonant spacing S such that a rate of heat transfer through the dryer shell 12 from the inner surface 16 to the outer surface 34 is minimized while optimizing a temperature uniformity in the cross machine direction CD. The quarter-resonant spacing S is determined by an equation:

$$S=4\pi(R_i\delta)^{1/2} \text{ in which;}$$

S=the quarter-resonant spacing;

$\pi$=3.1415;

$R_i$=the inside radius of the inner surface 16 of the dryer shell 12 in inches;

$\delta$=an average depth of a layer 32 of condensed steam disposed adjacent to the inner surface 16 in inches.

In a more specific embodiment of the present invention as shown in FIG. 9, the apparatus 36 includes six dryer bars 18 to 23. A cross-section of each of the bars 18 to 23 is within a range from 0.25 inches×0.25 inches to 1.0 inches×1.50 inches. Each of the bars 18 to 23 is metallic and of hollow tubular configuration. Preferably, the bars are fabricated from stainless steel. The apparatus 36 includes at least one hoop made up of the three segments 24-26 for pressing each of the bars 18 to 23 against the inner surface 16 of the dryer shell 12. The at least one hoop includes at least one segment such as segment 24

Also, the at least one hoop includes a number of segments 24-26 within a range 2 to 4, each segment such as segment 24 having a first and a second end 48 and 50 respectively.

Figure 9A:
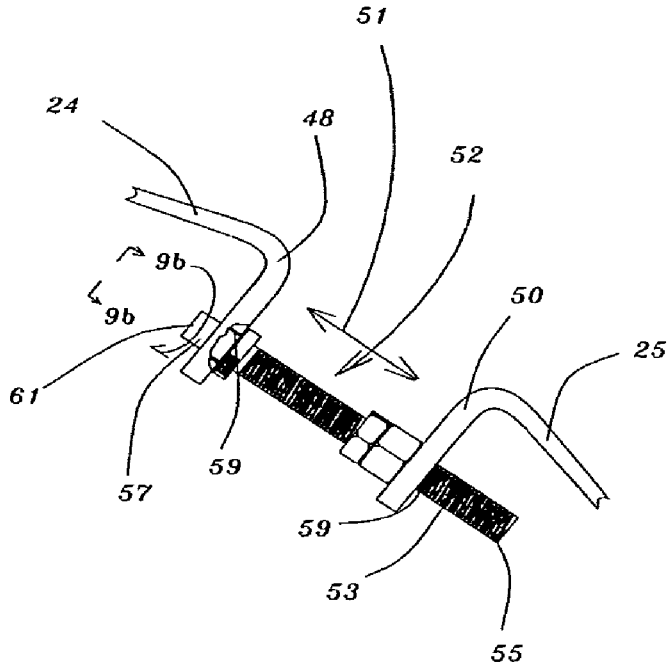
FIG. 9*a* is an enlarged view of the fastener shown in FIG. 9.

FIG. 9*a* is an enlarged view of the fastener 52 shown in FIG. 9. As shown in FIG. 9*a*, a segment fastener 52 is disposed between the first end 48 of the segment 24 and a second end 50 of the adjacent segment 25 for forcing adjacent segments apart as indicated by the arrow 51. Each fastener 52 is threaded on one end 55 of the ends 55 and 57 thereof. Each of the hoop segments 24-26 defines a hole 59 in each end 48 and 50 thereof, for engagement with a segment fastener 52. Each of the segment fasteners 52 has a head 61 that passes through the hole 59 in the end 48 of the segment such as segment 24.

Figure 9B:
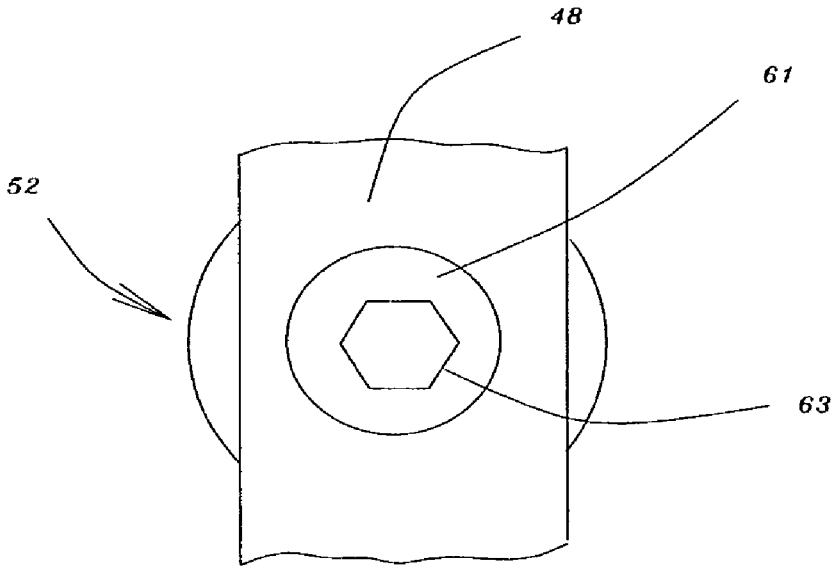
FIG. 9*b* is a view taken on the line 9*b*-9*b* of FIG. 9*a*

FIG. 9*b* is a view taken on the line 9*b*-9*b* of FIG. 9*a*. As shown in FIG. 9*b*, a hexagonal socket head 63 is defined by the fastener 52 for permitting tightening of the fastener 52 by a power tool.

Figure 9C:
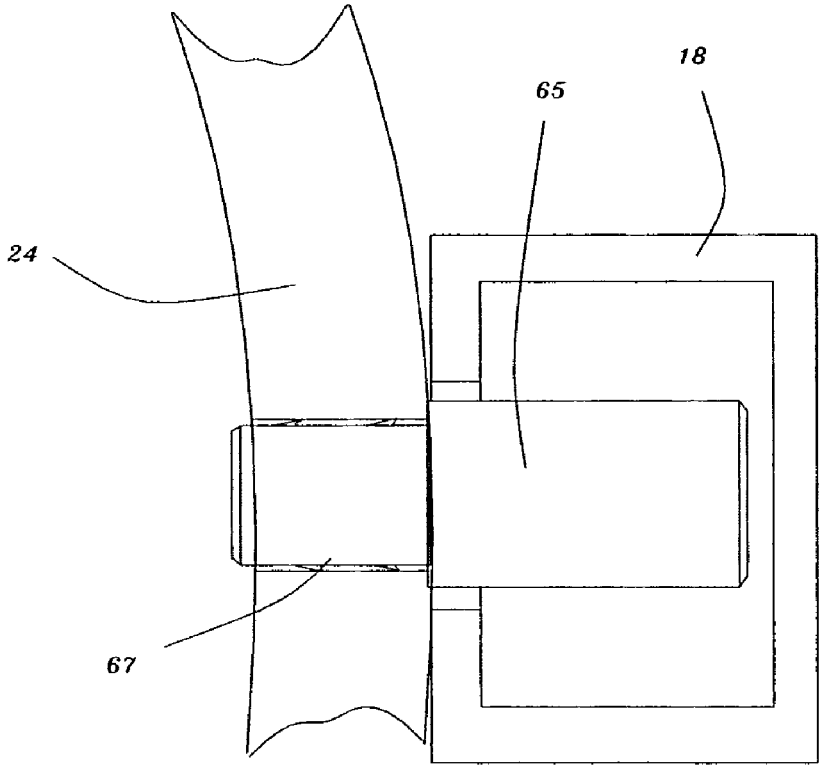
FIG. 9*c* is an enlarged view of a cylindrical pin for connecting each bar to an adjacent segment.

FIG. 9*c* is an enlarged view of a cylindrical pin for connecting each bar to an adjacent segment. As shown in FIG. 9*c*, a cylindrical pin 65 is provided for connecting each of the bars such as bar 18 of bars 18 to 23 to an adjacent segment 24.

More specifically, the pin 65 has an interference boss 67 to hold the pin 65 in the segment 24. The pin 65 extends far enough out of the segment 24 and into the bar 18 so that disengagement of the pin 65 from the segment 24 is prevented.

The specific configuration of the segment fasteners is disclosed in the aforementioned co-pending application, now U.S. Pat. No. 7,028,756 issued on Apr. 18th 2006. All of the disclosure of the aforementioned application now U.S. Pat. No. 7,028,756 issued on April 18th 2006, is incorporated herein by reference.

The present invention also provides a method of improving a cross-directional heat transfer profile of a papermaking dryer cylinder. The method includes the steps of holding a number N of bars 18 to 23 axially against an inside surface 16 of the dryer cylinder 12. The number N is within a range 3 to 9. Hoop segments 24-26 are then located within the dryer cylinder 12 such that each segment 24 to 26 is disposed in a generally circumferential position.

The dryer bars of the subject invention provide improvements in the dryer surface temperature profiles in the cross-machine direction while simultaneously maintaining low dryer surface temperatures. The invention can be used in those paper dryers that require improved dryer surface temperature profile uniformity, but also require low surface temperatures. The low dryer surface temperatures help to reduce the tendency for the wet sheet to pick, cause Tinting and dusting, and cause problems with sheet runnability. The invention is particularly useful for improving the profile uniformity in those dryer cylinders that are operating above the condensate rimming speed, with stationary syphons.

What is claimed is:

1. A dryer bar apparatus of a dryer for drying a web in a papermaking machine, said apparatus comprising:

a rotatable dryer shell of cylindrical configuration, said dryer shell having an outer surface for drying the web;

said dryer shell having an inner surface which defines an enclosure, said inner surface having a radius Ri;

said enclosure being connected to a source of pressurized steam such that in operation of the dryer, a transfer of thermal energy from the steam within said enclosure through said inner surface of said dryer shell to said outer surface of said dryer shell is achieved so that the web is dried;

a syphon disposed within said enclosure for controlling a layer of condensed steam accumulating adjacent to said inner surface of said dryer shell during operation of said apparatus;

a specific number of turbulence bars disposed within said enclosure for maximizing uniformity of said transfer of thermal energy in a cross machine direction and minimizing said transfer of thermal energy through said dryer shell from said inner to said outer surface, each of said turbulence bars extending in a cross machine direction in contact with said inner surface, said bars being circumferentially spaced equidistantly around said inner surface of said dryer shell for generating turbulence within said layer so that uniformity of said transfer of thermal energy in said cross machine direction is maximized while said transfer of thermal energy through said dryer shell from said inner to said outer surface is minimized; and said maximizing uniformity of said transfer of thermal energy in said cross machine direction and minimizing said transfer of thermal energy through said dryer shell from said inner to said outer surface being attained by the fitting of said specific number of turbulence bars within said dryer shell;

said specific number of turbulence bars being determined by the equation:

$$N=\text{int}\{[2\pi Ri/[4\pi(Ri\delta)^{1/2}W]\}$$

in which:

N=said specific number of turbulence bars in said dryer shell;

int=an integer number of a value in { } brackets;

$\pi$=3.1415;

Ri=said inside radius of said inner surface of said dryer shell in inches;

$\delta$=an average depth of said layer in inches;

W=a width of each of said turbulence bars in inches.

2. A dryer bar apparatus as set forth in claim 1 wherein said number of turbulence bars is equal to N±1.

3. A dryer bar apparatus as set forth in claim 1 wherein said number of turbulence bars is equal to N±2.

4. A dryer bar apparatus as set forth in claim 3 further including:

a further number of hoop segments spaced circumferentially along said inner surface of said dryer shell for holding said turbulence bars in contact with said inner surface;

said number of turbulence bars being a multiple of said further number of hoop segments.

5. A dryer bar apparatus as set forth in claim 1 wherein N=3.

6. A dryer bar apparatus as set forth in claim 1 wherein N=4.

7. A dryer bar apparatus as set forth in claim 1 wherein N=5.

8. A dryer bar apparatus as set forth in claim 1 wherein N=6.

9. A dryer bar apparatus as set forth in claim 1 wherein N=7.

10. A dryer bar apparatus as set forth in claim 1 wherein N=8.

11. A dryer bar apparatus as set forth in claim 1 wherein N=9.

12. A dryer bar apparatus of a dryer for drying a web in a papermaking machine, said apparatus comprising:

a rotatable dryer shell of cylindrical configuration, said shell defining an outer and an inner surface;

a number of dryer bars pressed outwardly against said inner surface, each of said bars extending in a cross machine direction along said inner surface; and each bar being spaced from an adjacent bar by a quarter-resonant spacing for maximizing uniformity of said transfer of thermal energy in said cross machine direction and minimizing said transfer of thermal energy through said dryer shell from said inner to said outer surface; such that a rate of heat transfer through said dryer shell from said inner to said outer surface is minimized while optimizing a temperature uniformity in said cross machine direction.

13. A dryer bar apparatus as set forth in claim 12 wherein said quarter-resonant spacing is determined by an equation:

$S=4\pi(Ri\delta)^{1/2}$ in which;

S=said quarter-resonant spacing;

$\pi$=3.1415;

Ri=said inside radius of said inner surface of said dryer shell in inches;

$\delta$=an average depth of a layer of condensed steam disposed adjacent to said inner surface in inches.

14. An apparatus as set forth in claim 12 wherein a cross-section of each of said bars is within a range from 0.25 inches×0.25 inches to 1.0 inches×1.50 inches;

each of said bars is metallic and of hollow tubular configuration;

said apparatus including:

at least one hoop for pressing each of said bars against said inner surface of said dryer shell;

said at least one hoop including:

at least one segment.

15. A dryer bar apparatus of a dryer for drying a web in a papermaking machine, said apparatus comprising:

a rotatable dryer shell of cylindrical configuration, said shell defining and outer and an inner surface;

a number of dryer bars pressed outwardly against said inner surface, each of said bars extending in a cross machine direction along said inner surface;

each bar being spaced from an adjacent bar by a quarter-resonant spacing such that a rate of heat transfer through said dryer shell from said inner to said outer surface is minimized while optimizing a temperature uniformity in said cross machine direction;

a cross-section of each of said bars being within a range from 0.25 inches×0.25 inches to 1.0 inches×1.50 inches;

each of said bars being metallic and of hollow tubular configuration;

said apparatus including:

at least one hoop for pressing each of said bars against said inner surface of said dryer shell;

said at least one hoop including:

at least one segment;

said at least one hoop including:

a number of segments within a range 2 to 4, each segment having a first and a second end;

a segment fastener disposed between said first and a second end of an adjacent segment for forcing adjacent segments apart;

each fastener being threaded on one of said ends thereof;

each of said hoop segments defining a hole in each end thereof for engagement with a segment fasteners;

each of said segment fasteners having a head that passes through said hole in said end of said segment;

a hexagonal socket head defined by said fastener for permitting tightening of said fastener by a power tool; and a cylindrical pin for connecting each of said bars to an adjacent segment.

16. An apparatus as set forth in claim 15 wherein said pin has an interference boss to hold said pin in said segment;

said pin having a shoulder to prevent said pin from coming out of said segment, said pin extending far enough out of said segment and into said bar so that disengagement of said pin from said segment is prevented.

* * * * *

UNITED STATES PATENT AND TRADEMARK OFFICE

CERTIFICATE OF CORRECTION

PATENT NO. : 7,673,395 B2
APPLICATION NO. : 10/715889
DATED : March 9, 2010
INVENTOR(S) : Gerald L. Timm and Gregory L. Wedel It is certified that error appears in the above-identified patent and that said Letters Patent is hereby corrected as shown below:

In column 12, line 10 delete "Tinting" and insert therefor --linting--

Signed and Sealed this

Eleventh Day of May, 2010

David J. Kappos

David J. Kappos
*Director of the United States Patent and Trademark Office*